US006551219B1

(12) United States Patent
Brown

(10) Patent No.: US 6,551,219 B1
(45) Date of Patent: Apr. 22, 2003

(54) CYCLIC ERGOMETER

(76) Inventor: David Alan Brown, 9358 Forestview, Evanston, IL (US) 60203

( * ) Notice: Subject to any disclaimer, the term of this patent is extended or adjusted under 35 U.S.C. 154(b) by 0 days.

(21) Appl. No.: 09/311,621

(22) Filed: May 13, 1999

Related U.S. Application Data

(60) Provisional application No. 60/085,485, filed on May 14, 1998.

(51) Int. Cl.[7] ..... A63B 22/06; A63B 69/16

(52) U.S. Cl. ..... 482/57; 482/51; 482/91; 482/142

(58) Field of Search ..... 482/51, 57, 63, 482/64, 65, 91, 96, 142

(56) References Cited

U.S. PATENT DOCUMENTS

| | | | | | |
|---|---|---|---|---|---|
| 339,638 | A | | 4/1886 | Goldie | |
| 2,209,034 | A | * | 7/1940 | Paul | 482/57 |
| 3,586,322 | A | | 6/1971 | Kverneland | 272/72 |
| 3,658,327 | A | | 4/1972 | Thiede | 272/79 R |
| 3,709,487 | A | | 1/1973 | Walker | 272/58 |
| 3,892,404 | A | | 7/1975 | Martucci | 272/79 R |
| 4,004,801 | A | | 1/1977 | Campanaro et al. | 272/120 |
| 4,101,124 | A | | 7/1978 | Mahnke | 272/134 |
| D251,079 | S | | 2/1979 | Shugarman | D34/5 K |
| D265,110 | S | | 6/1982 | Lafont | D21/195 |
| 4,372,551 | A | | 2/1983 | Yurdin | 972/73 |
| 4,383,684 | A | | 5/1983 | Schliep | 272/120 |
| D280,537 | S | | 9/1985 | Law | D21/191 |
| D284,597 | S | | 7/1986 | Smith et al. | D21/195 |
| 4,700,946 | A | * | 10/1987 | Breunig | 272/134 |
| 4,706,953 | A | | 11/1987 | Graham | 272/120 |
| 4,717,148 | A | * | 1/1988 | Brewer | 272/145 |
| 4,911,438 | A | | 3/1990 | Van Straaten | 272/138 |
| 5,169,363 | A | | 12/1992 | Campanaro et al. | 482/96 |
| 5,232,426 | A | | 8/1993 | Van Straaten | 482/123 |
| 5,269,736 | A | * | 12/1993 | Roberts | 482/62 |
| D347,251 | S | | 5/1994 | Dreibelbis et al. | D21/195 |
| D356,839 | S | | 3/1995 | Ferdinand | D21/191 |
| D362,700 | S | | 9/1995 | Breibart et al. | D21/195 |
| 5,620,403 | A | | 4/1997 | Lundin | 482/96 |
| 5,649,885 | A | | 7/1997 | Liljenquist et al. | 482/95 |
| D382,319 | S | | 8/1997 | Gerschefske et al. | D21/195 |
| 5,782,639 | A | * | 7/1998 | Beal | 434/29 |
| D405,132 | S | | 2/1999 | Westfall et al. | D21/676 |
| 6,168,553 | B1 | * | 1/2001 | Kuo | 482/57 |

* cited by examiner

*Primary Examiner*—Nicholas D. Lucchesi
*Assistant Examiner*—Tam Nguyen
(74) *Attorney, Agent, or Firm*—Piper Rudnick; Jefferson Perkins

(57) ABSTRACT

An exercise or physical therapy apparatus provides both tonic and phasic exercise to selected muscle groups of a user, such as the muscles of the arms or legs. The phasic exercise may be accomplished by a cycle. The tonic exercise is accomplished by subjecting the muscle group to a constant load, such as a user- or therapist-selected portion of the user's body weight, by springs, or by weights. A measurement device measures the degree of displacement of the user's torso, it being an objective of the user to keep the torso stationary.

20 Claims, 12 Drawing Sheets

CYCLIC ERGOMETER

RELATED APPLICATION

This application claims priority to provisional application Serial No. 60/085,485, filed May 14, 1998, which is fully incorporated by reference herein.

STATEMENT OF GOVERNMENTAL RIGHTS IN INVENTION

Pursuant to 37 CFR 501.6 (a), the United States Government has a nonexclusive, royalty-free, irrevocable license in the present invention and to this application, with the power to grant sublicenses for all governmental purposes.

TECHNICAL FIELD OF THE INVENTION

The present invention relates in general to physical rehabilitation and exercise apparatus, and more particularly to physical therapy and exercise apparatus that provide both phasic and tonic exercise to a muscle group.

BACKGROUND OF THE INVENTION

There are many exercise devices that are used to strengthen muscles of the lower or upper extremities. In regard to the legs, it is important to find exercises for increasing strength in functional weight-bearing tasks such as walking, running and jumping, while minimizing the damage to joints that may occur with repetitive training of these tasks. Currently available bicycle ergometers, although providing a good exercise for minimizing joint loading stress, all involve some seating mechanism that absorbs most of the body weight, such that weight-bearing on the exercised extremities is minimized.

One device, the cardiac stress table disclosed in U.S. Pat. No. 4,372,551, was developed to aid in the diagnostic imaging of the heart during different levels of cardiac stress. This device can tilt an individual about the approximate hip center and uses a shoulder pad system to retain the trunk in selected tilt positions. The device uses seated pedaling and therefore does not place significant tonic loads on the legs.

The victims of stroke and other medical conditions often lose much of their ability to retain their balance. Vertical sway is an indication of the user's ability to control his or her center of mass during movement and is an important indicator of balance difficulties. According to conventional testing, sway tests are performed on a patient while the patient stands on a force platform. However, research indicates that these tests are poor predictors of falling behavior during locomotion, because they test individuals during quiet standing and not during movement.

Even in view of these and other prior art physical therapy and test apparatus, therefore, a need exists for physical therapy and exercise equipment that can effectively combine tonic with phasic exercise of muscle groups, such as occur in the legs and arms, and a further need exists for improved testing and treatment of balance disorders that result in falls during locomotion.

SUMMARY OF THE INVENTION

According to one aspect of the invention, physical therapy or an exercise apparatus is provided that provides both tonic and phasic exercise of preselected muscle groups, and in particular the muscle groups in the arms or legs of a user or patient. The invention includes first and second patient extremity contact surfaces, such as pedals or handgrips, which are rotatably mounted to a frame so as to define phasic exercise paths. The pedals/handles are coupled to a suitable source of resistance, such as a flywheel; it is preferred that the amount of resistance experienced by the user in performing the phasic activity be constant. A sled or torso carrier is slidably coupled to a frame and is movable in a path towards and away from the pedals/handles. The sled is biased toward the pedals/handles by a force, selectable in amount by the user or therapist, such that the muscle group being exercised receives a predetermined tonic load.

In one embodiment, the weight of the patient's body itself is used to bias the torso carrier toward the pedals/handles; the patient must work to support the torso so as to be substantially constantly spaced from the pedals/handles, while at the same time performing a phasic muscle activity (such as advancing a crank). To select the amount of body weight which tonically loads the exercised extremities, the sled frame or track is tilted by an amount preselectable by the user around a pivot with respect to the rest of the frame. In other embodiments, the biasing is provided by springs or elastic bands. In yet another embodiment, this tonic loading is provided by a system of pulleys and weights. degree of movement of the sled may be fed back to the user, as by means of a visual display. The objective of the user is to keep the sled as stationary as possible while doing the phasic muscular exercise.

One technical advantage of the invention is that the tonic, or supportive, loading created by the ergometer adds an extra degree of muscle activity that becomes an effective stimulus for strengthening the muscles of the leg or arm. This extra degree of muscle strengthening occurs in muscle groups and with muscle actions that typically are not used during pedalling.

The main physiological effect during phasic exercise is the repetitive and sequential activation of muscle during the shortening and lengthening phases of the cycle. Typically, exercises are performed that focus on either lengthening or shortening contractions. The present invention heightens this effect by adding more loading to the activity. In embodiments provided to exercise the legs, the present invention advantageously trains the muscles of the legs to perform the kind of sequential eccentric and concentric contractions that occur in many daily locomotive activities.

Another advantage of the invention is that it is a closed-chain kinetic exercise. Open-chain exercises are potentially dangerous to the affected joints and muscles because they may put undue stress on these anatomical structures. In closed-chain exercises, such as those employed by the invention, the distal segment of the extremity is stabilized so that stresses on the exercised extermity are reduced. Closed-chain exercises are safer and more functionally relevant than the class of open-chain, isokinetic devices that are conventionally used to strenghten the legs and arms.

BRIEF DESCRIPTION OF THE DRAWINGS

Further aspects of the invention and their advantages may be discerned from the following detailed description when read in conjunction with the drawings, in which like characters identify like parts and in which.

DETAILED DESCRIPTION OF ILLUSTRATED EMBODIMENTS

Figure 1:
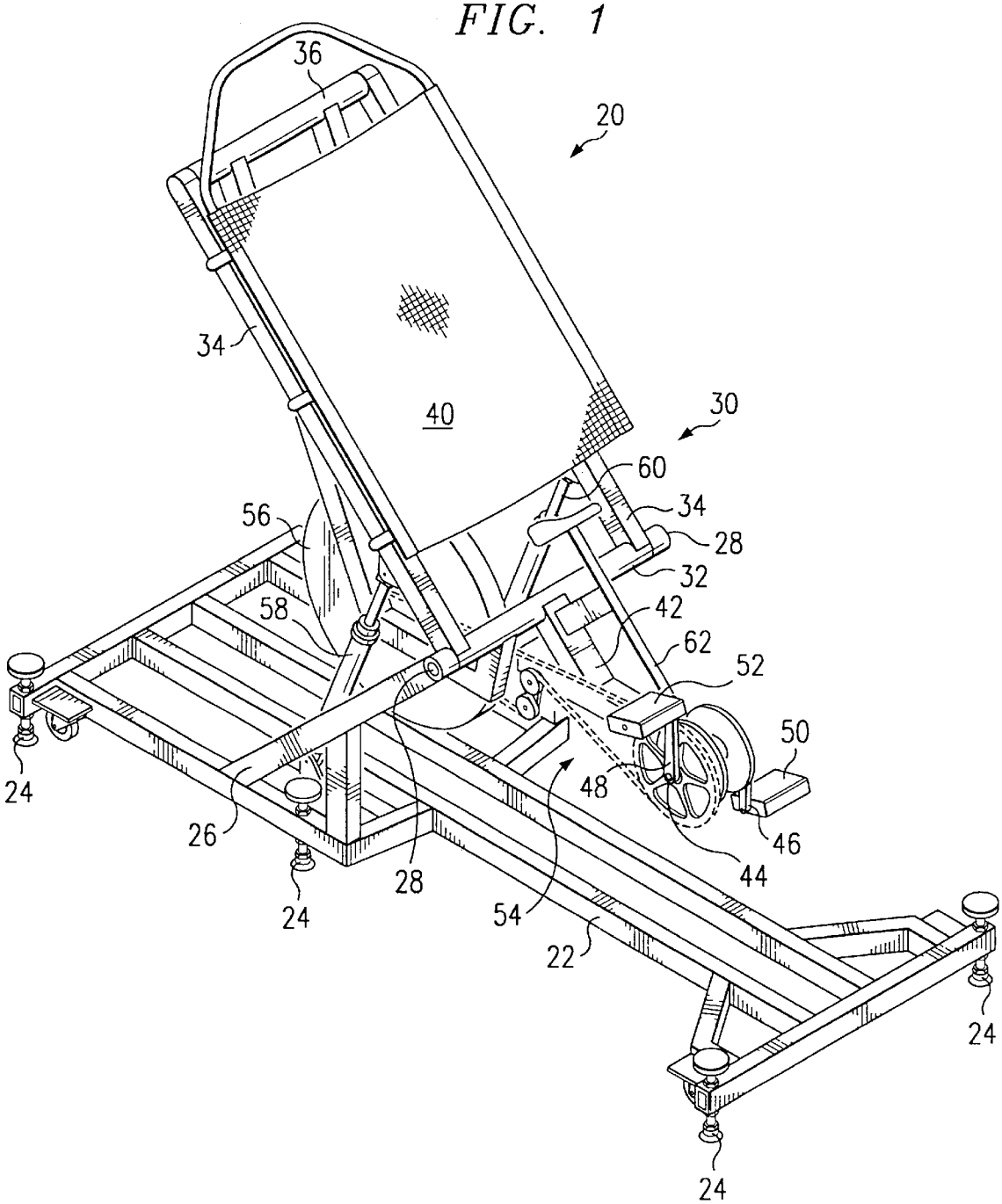
FIG. 1 is an isometric view of a cyclic ergometer according to a first embodiment of the invention, in which the legs of a user are being exercised and in which a preselected portion of the weight of the user is placed on the legs to provide tonic loading.

FIG. 1 shows a first embodiment 20 of the invention, which is adapted to exercise the legs of a user and with which a predetermined amount of the body weight of the user provides tonic exercise to the leg muscles. A base frame 22 is leveled with respect to the floor using a plurality of screw casters 24. The frame 22 includes opposed upright pier members 26 from which the remainder of the ergometer 20 is supported by means of pivots 28. This remainder of the ergometer 20 is built around a tilt frame indicated generally at 30, which in the illustrated embodiment has a lateral base member 32 which spans between pivots 28, two opposed side or rail members 34 which are parallel to each other and which extend away from the lateral member 32, and a far end lateral member 36 which joins remote ends 38 of the side members 34. Other structural members of the tilt frame 30 and the base frame 22 are provided as necessary for structural strength and rigidity. Frames 22 and 30 may be conveniently fabricated of steel.

Slidably mounted on the tilt frame 30 is a torso carrier or sled 40; As will be described in further detail below, the sled 40 slides on side members 34 toward, and away from, the base horizontal member 32. A crank support member 42 extends outwardly from the base horizontal member 32, in a direction opposite to that of the side members 34, so as to provide a support for a crank 44. The crank 44, conveniently built of bicycle parts, includes first and second crank arms 46 and 48 and pedals 50 and 52 which are adapted to receive the user's feet. The torso sled is designed to slide toward, and away from, the crank 44. A torso sled 40 is used so that the sled does not interfere with flexion of the user's legs when the user engages the pedals and moves his legs to rotate the crank 44. Mainly, the sled has a support surface that the user lies on so that the range of flexion of the legs at the hip joint from a sitting position (with the knee bent) toward a fully extended straight (lying-down) position is not interfered with by the sled 40. In the embodiment illustrated in FIGS. 1–6, the path of the sled 40 is linear, although a curved path could also be employed for different loading effects depending on relative sled/tilt frame position.

A drive train, indicated generally at 54, connects the crank 44 to a suitable source of resistance, such as flywheel 56. Structures such as lead screws 58 and 60 are mounted between the base frame 22 and the tilt frame 30 and are used to select and retain the desired degree of slope of the tilt frame 30 with respect to the horizontal. A torso support 62, which extends toward the tilt frame 30, is mounted on the crank support member 42 and provides a stop (which may take the shape of a seat) in case the user is unable to support the preselected portion of weight of the user's body using his or her legs.

Figure 2:
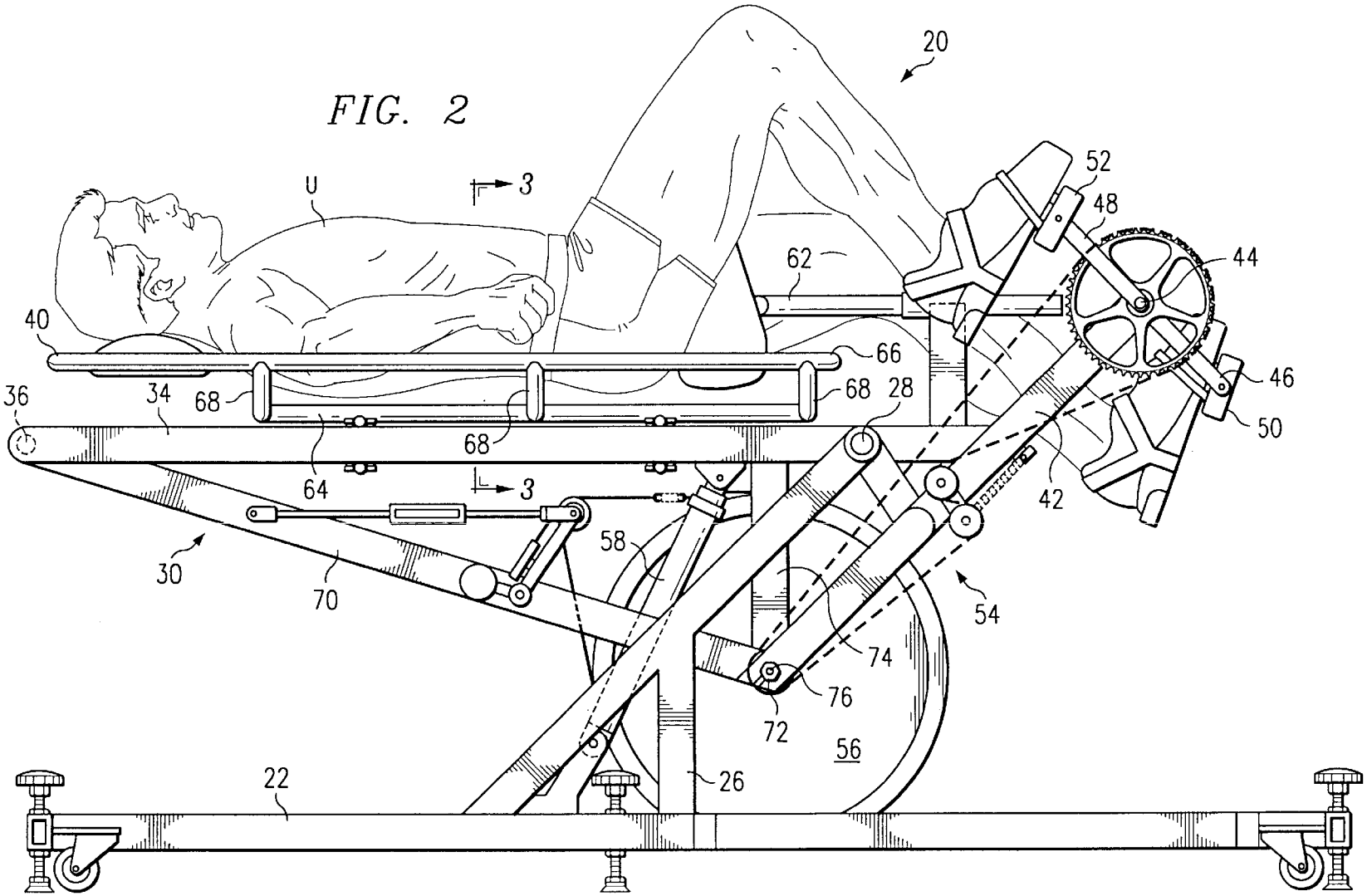
FIG. 2 is an elevational view of the embodiment shown in FIG. 1, showing the apparatus in a horizontal position.

Further details of the first embodiment of the invention are shown in FIG. 2. As seen in this FIGURE, the tilt frame 30 has been adjusted to be entirely horizontal, such that no weight of the user U is placed on his leg muscles. In this position and in this embodiment, the user is providing phasic exercise to certain leg muscle groups, but no tonic exercise at all. The sled 40 is conveniently fabricated of several tubular lightweight metal members, including a pair of base members 64 (one shown in this FIGURE), a top rail member 66, and several interconnecting cross members 68. The tilt frame 30 includes a diagonal structural member 70 which connects the head or remote crosspiece 36 to a joint 72, to which is also attached a vertical structural member or flywheel stay 74 and the crank support member 42. Joint 72 also serves as the mounting for an axle 76 of the flywheel 56. The flywheel stay 74 provides the principal support of the flywheel 56 and is joined to the tilt frame base member 32.

Figure 3:
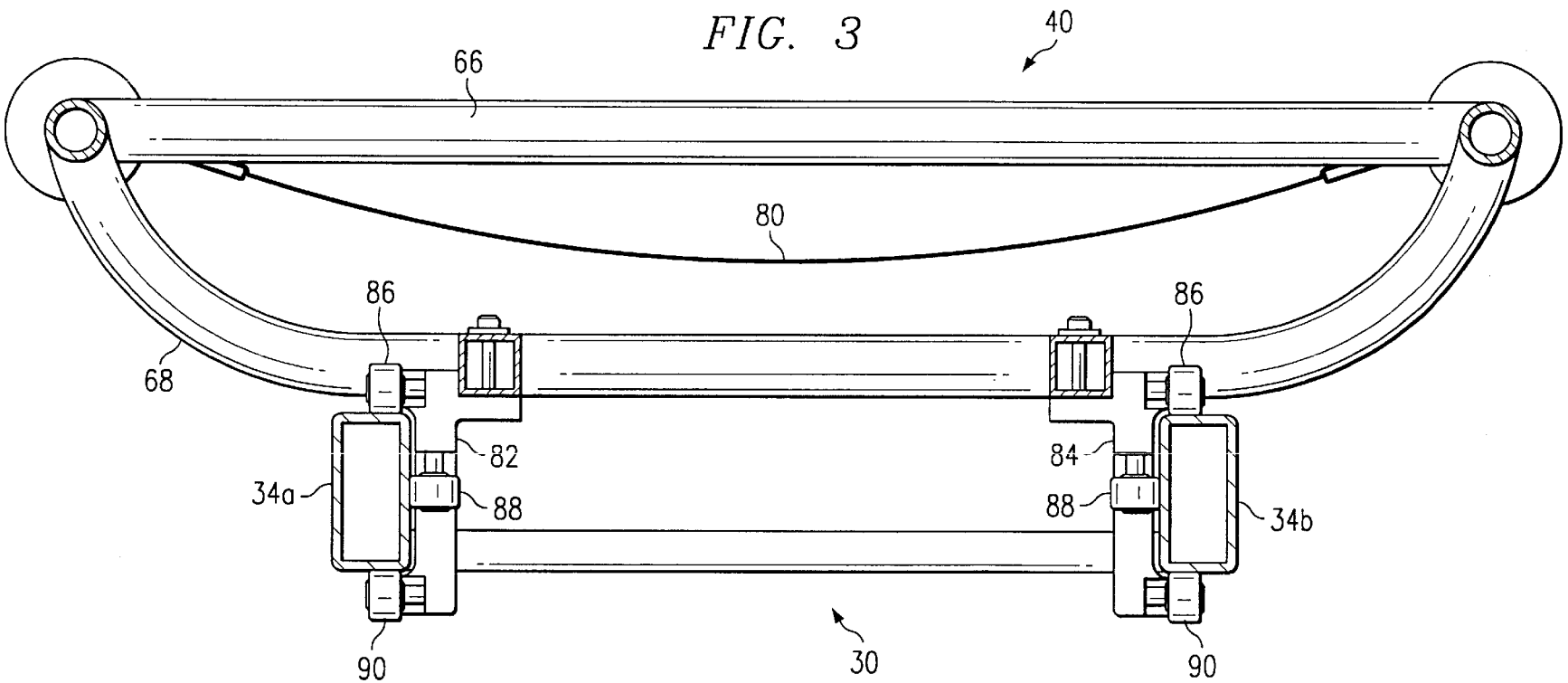
FIG. 3 is a cross-sectional view taken substantially along line 3—3 of FIG. 2.

FIG. 3 is a cross-sectional view showing certain structural details of the torso sled 40. In the illustrated embodiment, there are several curved crossbars 68 which are horizontal throughout their middle sections, and then curve upward on each side, so as to provide a cradling framework for the user's body. Across this framework is stretched a web 80 of fabric for directly receiving the torso of the patient. Although not shown, the sled 40 may also be provided by a suitable harness or straps to prevent the user from falling off of the ergometer and for keeping the user's torso in position.

Figure 4:
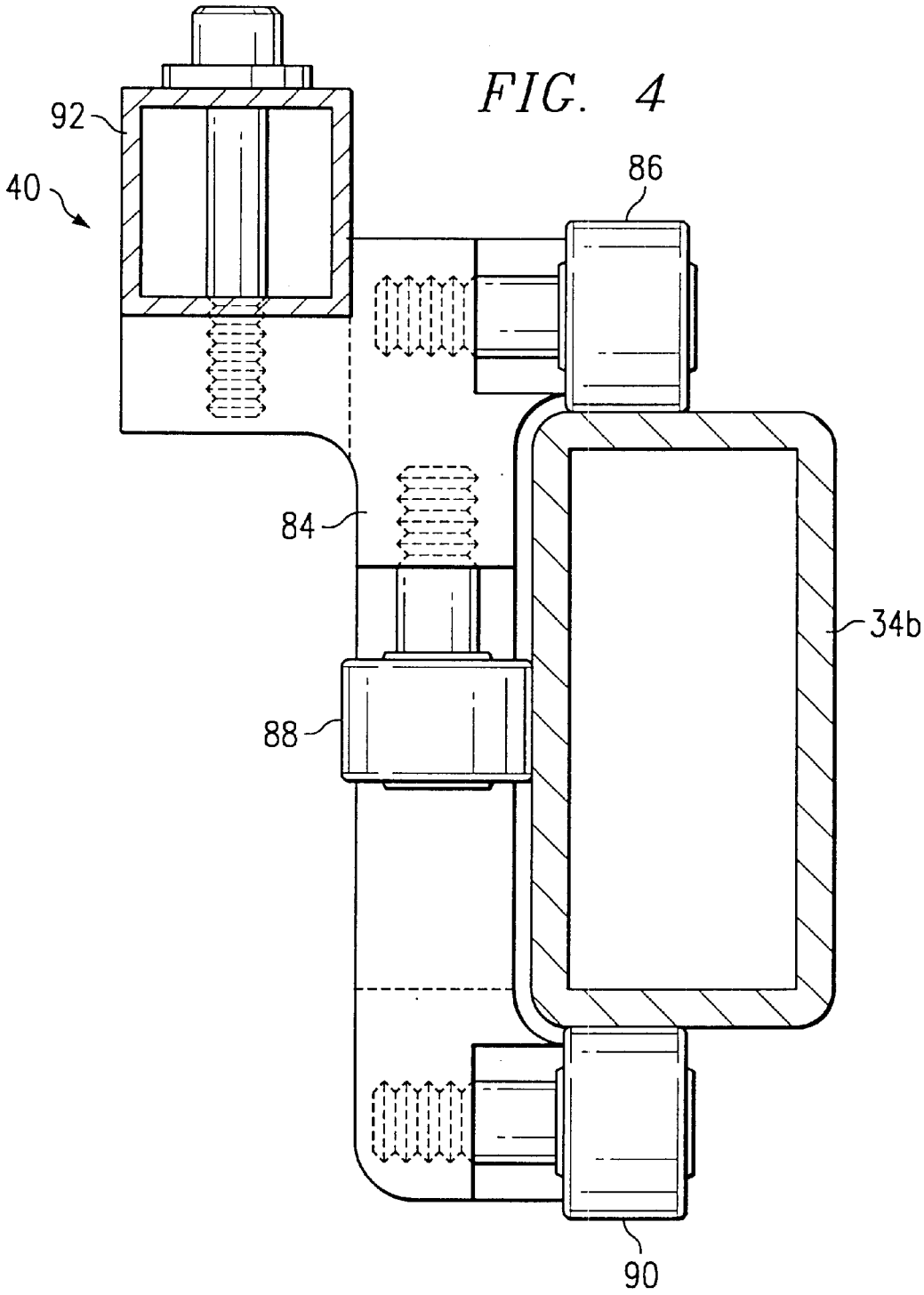
FIG. 4 is a cross-sectional detail showing a tilt frame member and the rolling contact therewith of the torso sled rollers.

Two such crossmembers 68 (one shown in this FIGURE) are each fitted with left and right roller brackets 82 and 84 which extend downwardly from the crossmembers 68 which they support. Each of the roller brackets is provided with a top roller 86, a side roller 88 and a bottom roller 90, which together rollably cage a respective side member 34*a* or 34*b* of the tilt frame 30. A detail of one such roller bracket 84 is shown in FIG. 4. By contacting the top, inner side and lower surfaces of the preferably rectangular rail 34*b*, the rollers 86, 88 and 90 constrain the movement of the sled 40 to move only along the rail 34*b*. The roller bracket 84 is, in turn, connected as by bolting to a longitudinal structural member 92 of the sled 40.

Figure 5:
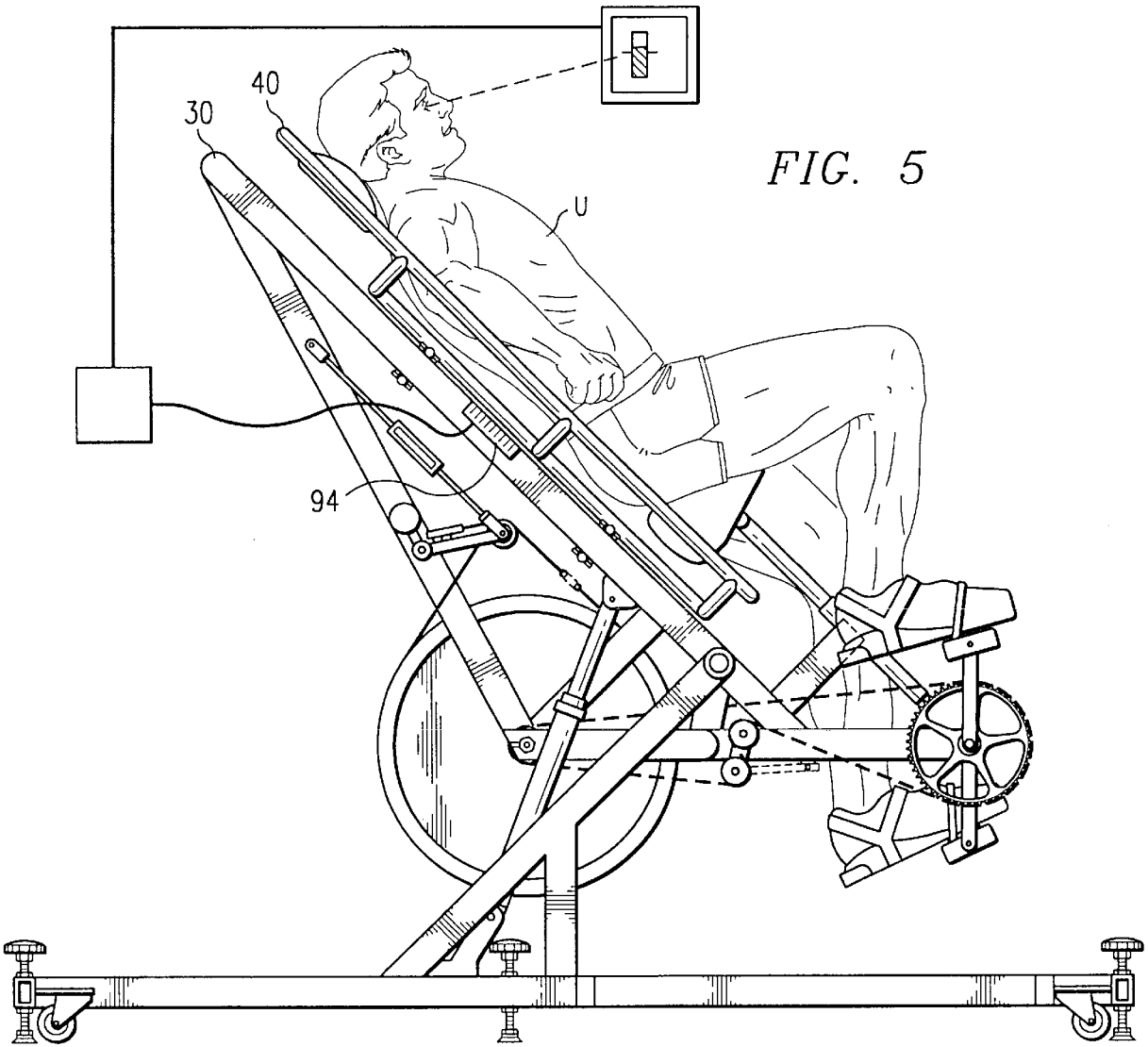
FIG. 5 is an elevational view of the embodiment shown in FIG. 2, with the tilt frame thereof tilted to about a 45 degree position.

FIG. 5 shows the tilt frame 30 of this embodiment tilted approximately 45 degrees to the horizontal. It will be appreciated that since the crank 44 is connected to the tilt frame 30, no matter how far the frame 30 is tilted, the crank 44 is maintained in the same position relative to the sled 40 so that the generally extending direction of the torso of the user U in the sled points toward the crank 44 as shown in FIG. 5. This avoids interference with flexion of the legs while, engaging the pedals or during pedaling. In the 45° tilted condition, about 70% of the body weight of the user U is being supported by the user's leg muscles, providing a degree of tonic loading of those muscles. The objective of the user U is to keep the sled 40 at the same position while cycling. A gauge 94 may be provided against which the movement of the sled 40 may be measured, and this gauge 94 may be instrumented using a linear potentiometer or other position indicator schematically illustrated at 95 to provide a recording of the user's efforts. This position indicator 95 may in turn be used as an input signal to a display 97, which is visible to the user U. In this manner, the user U may get feedback concerning the relative success of his or her efforts in keeping his or her torso stationary. The more the user U can control the position of the sled 40 on the tilt frame 30, the better his ability will be to walk normally without vertical sway or collapse. The position indicator signal may also be used by clinicians who are interested in knowing whether the user is capable of sustaining a certain level of loading during the exercise.

Also, single-limb load-bearing capability may be estimated from the position indicator by tracking the intra-cycle sway of the body. For example, if the body collapses when the left leg is applied during the downstroke, and the body recovers during the downstroke of the right leg, then it can be concluded that the left leg is functionally weaker than the right leg. Feedback about this asymmetry may be used to diagnose weakness problems and may be used to train patients to equalize the forces in the two legs.

Figure 6:
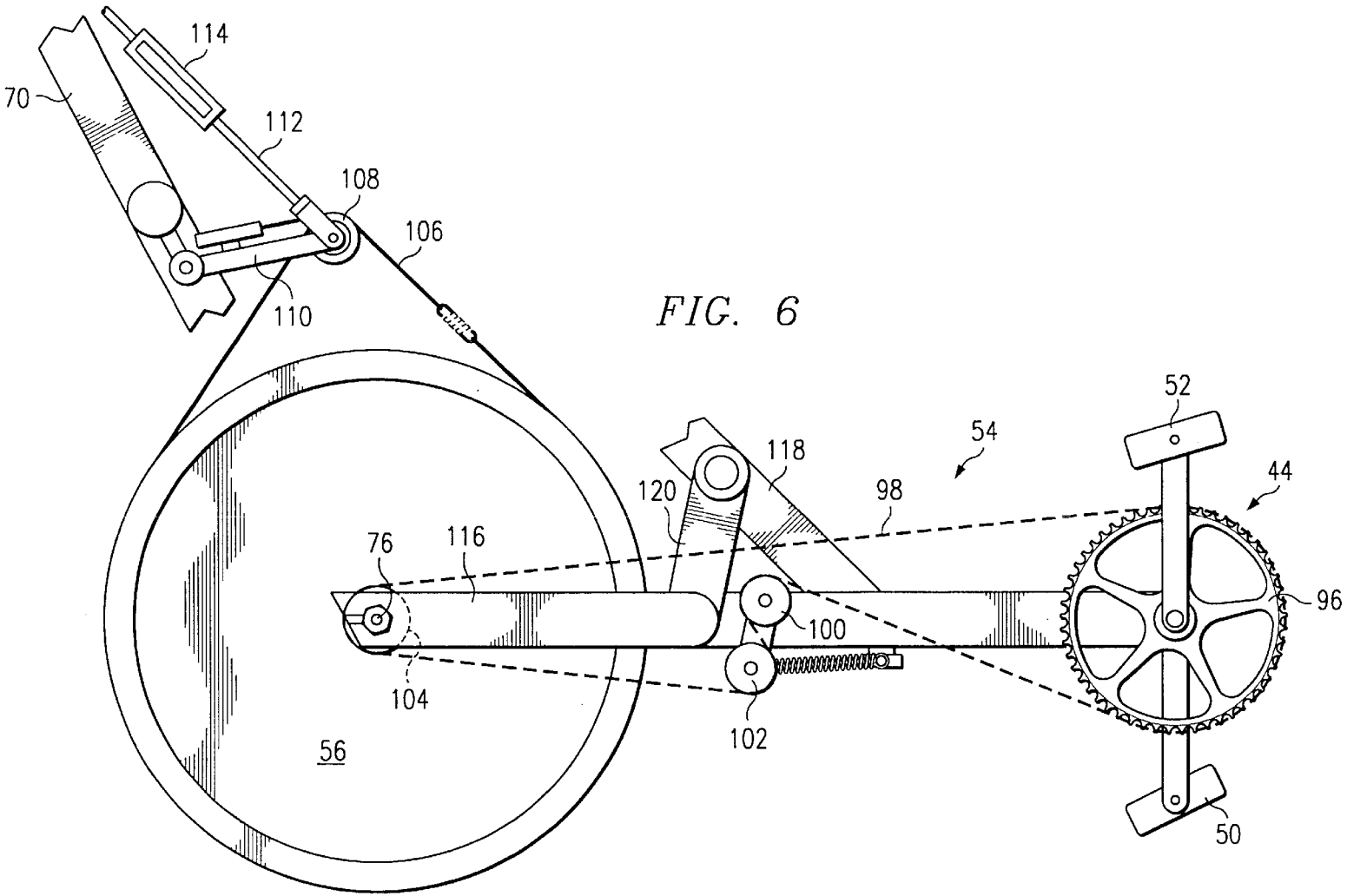
FIG. 6 is an elevational detail showing the drive linkage between the crank and a resistance-providing flywheel.

FIG. 6 is an elevational schematic diagram of the drive train 54 used in the first embodiment of the invention. A chainring 96 is affixed to the crank 44. While chainring 96 is shown as circular, alternatively it can be elliptical (see FIG. 8) or take a shape imitative of foot movement during locomotion. A linked chain 98 engages the teeth of the chainring 96 and is routed around a geared idler wheel 100 and a chainstay 102, after the manner of a conventional bicycle derailleur. The chain 98 next is routed around a sprocket 104 and then returns to the chainring 96. The resistance of the flywheel 56 is controlled through the tension of a band 106, which goes around the circumference of the flywheel 56 and a pulley 108. The pulley 108 is mounted on a pulley arm 110 which is hinged to structural tilt frame member 70. The pulley 108 is further connected to the frame 70 by a tensioning rod 112 and turnbuckle 114; the rotation of the turnbuckle 114, in one direction or another, will pull up or let down the tension pulley 108, in turn adjusting the tension under which band 106 is put.

The axle 76 and sprocket 104 are mounted to a structural member 116, which in turn is connected to a member 118 by a member 120.

Figure 7:
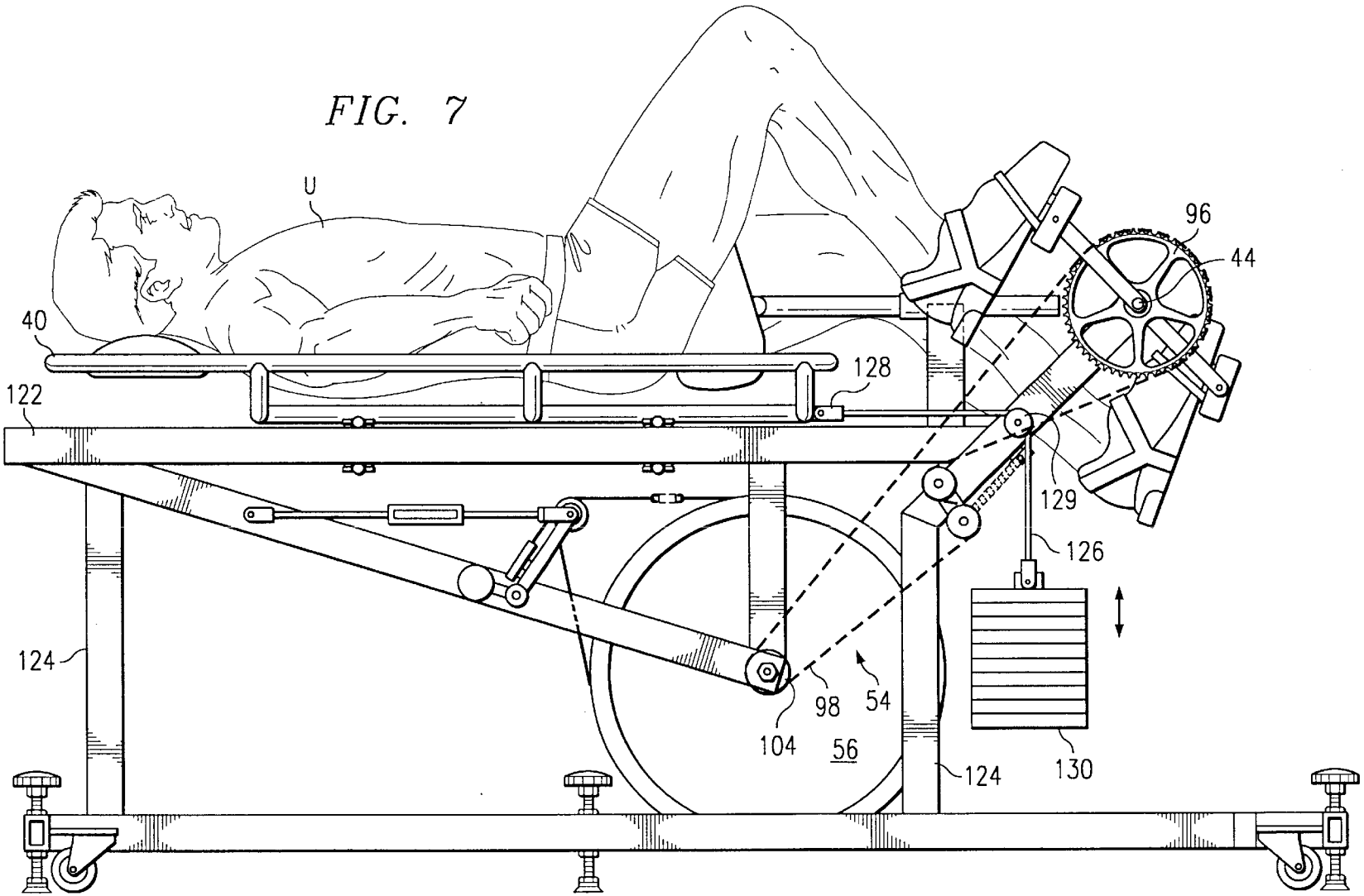
FIG. 7 is a simplified schematic elevational view of a second embodiment of the invention, in which tonic muscle exercise is provided with a system of weights and pulleys.

FIG. 7 shows a second embodiment of the invention, in which a user U lies supine on a sled 40, as before, which slides up and down on a sled frame 122, similar to the embodiment shown in FIGS. 1–6. However, in this embodiment there is no tilting of the sled frame, which instead can be less complexly made to be integral with the base frame 124. Also like the first embodiment, the user U may perform phasic exercise of his leg muscles by cycling the crank 44, which, as in the first embodiment, is connected by the drive train 54 to a source of resistance such as flywheel 56.

The major difference is how tonic loading of the leg muscles is accomplished. In this second embodiment, a cable 126 has a near end 128 attached to the near end of the torso sled 40. The cable 126 is passed over a redirecting pulley 129 that is mounted to the frame 124, and has a far end attached to a suitable cassette of weights 130. As per conventional weight lifting equipment, the number and weight of the weights 130 may be varied to vary the tension force communicated to the sled frame 40 through the cable 126. The user U endeavors to keep the sled 40 at a stationary position with respect to the frame 124, and thus subjects the leg muscles to tonic loading in keeping the sled 40 a predetermined distance away from the crank 44, much as a walking person keeps the torso of his body a predetermined distance off of the ground. To increase the tonic portion of the exercise, the weights 130 are increased, and to decrease the tonic portion of the exercise, the weights 130 are decreased.

Figure 8:
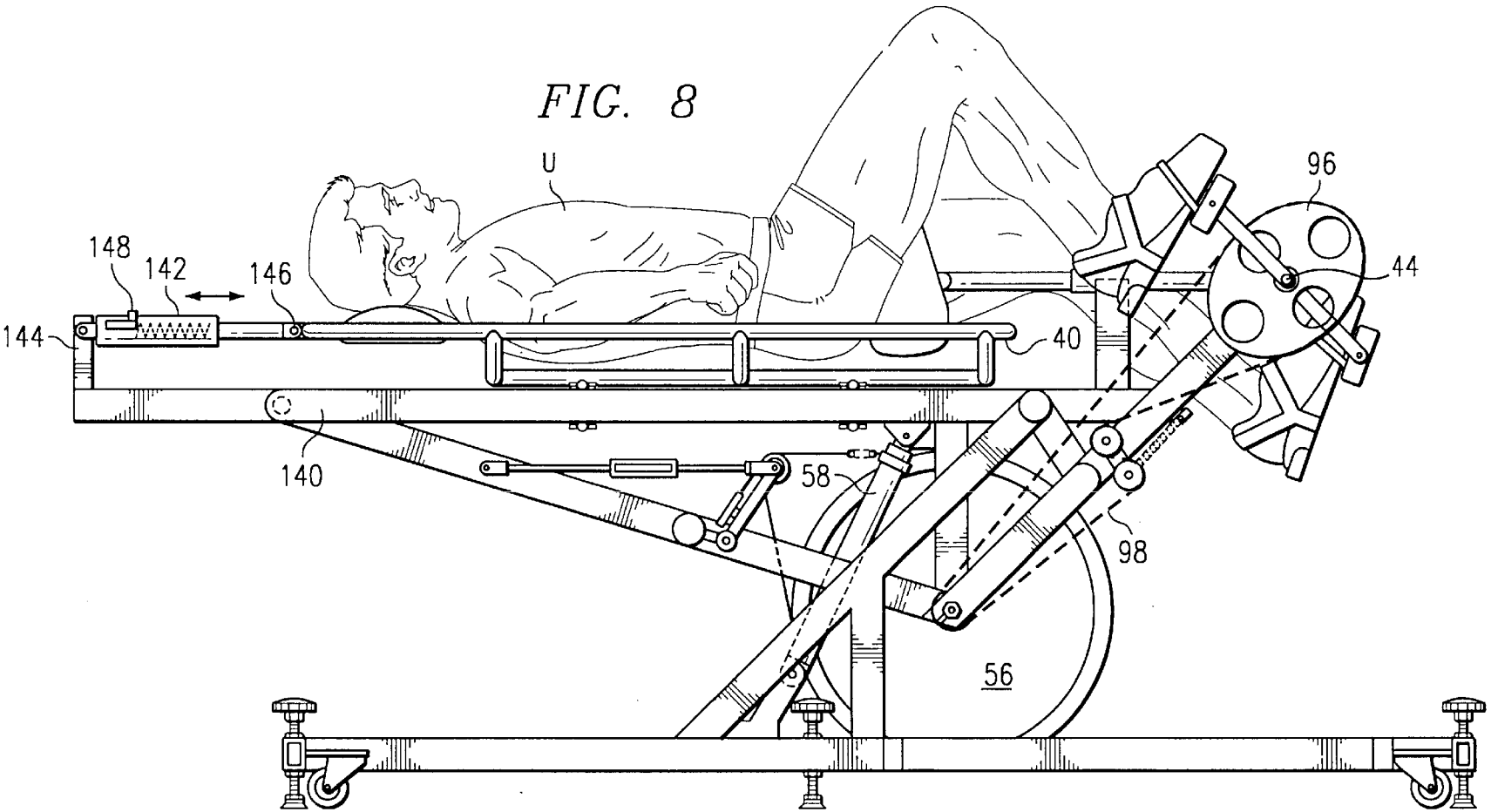
FIG. 8 is a simplified schematic elevational view of a third embodiment of the invention, in which tonic muscle exercise is provided with a compression spring, and also showing an elliptical chainring.

FIG. 8 shows a third embodiment of the invention. In this embodiment, the sled 40 is again slidable in a horizontal direction on a fixed, nonarticulating frame 140. The legs of the patient U are tonically loaded by means of a compression spring 142 which, on the left hand side as one is looking at FIG. 8 is mounted on extension 144 of the fixed frame 140, and at the right hand side is mounted to a top end 146 of the sled 40. An adjustment mechanism 148 is used to adjust the amount of spring force applied by the compression spring 142 (in the illustrated embodiment contained in a MacPherson strut-like arrangement) against the top end 146 of the sled 40. In this way, a preselected amount of load can be placed on the legs of the patient while the patient is cycling. Preferably, any biasing spring used to bias the torso carrier or sled in any of the embodiments of the invention is a constant-force spring. The remainder of the apparatus is the same as that disclosed in the first embodiment; the user U pedals a crank 44, which is connected via a chain 98 to a resistance-supplying flywheel 56 in order to provide phasic exercise to the legs.

In FIG. 8, the circular chainring has been replaced with an elliptical chainring 96*a*, illustrating how, in any of the illustrated embodiments, a noncircular cyclical path can be used for the phasic exercise. In another alternative embodiment, spring 142 can be a tension spring, which would place a negative tonic load on the user's legs.

Figure 9:
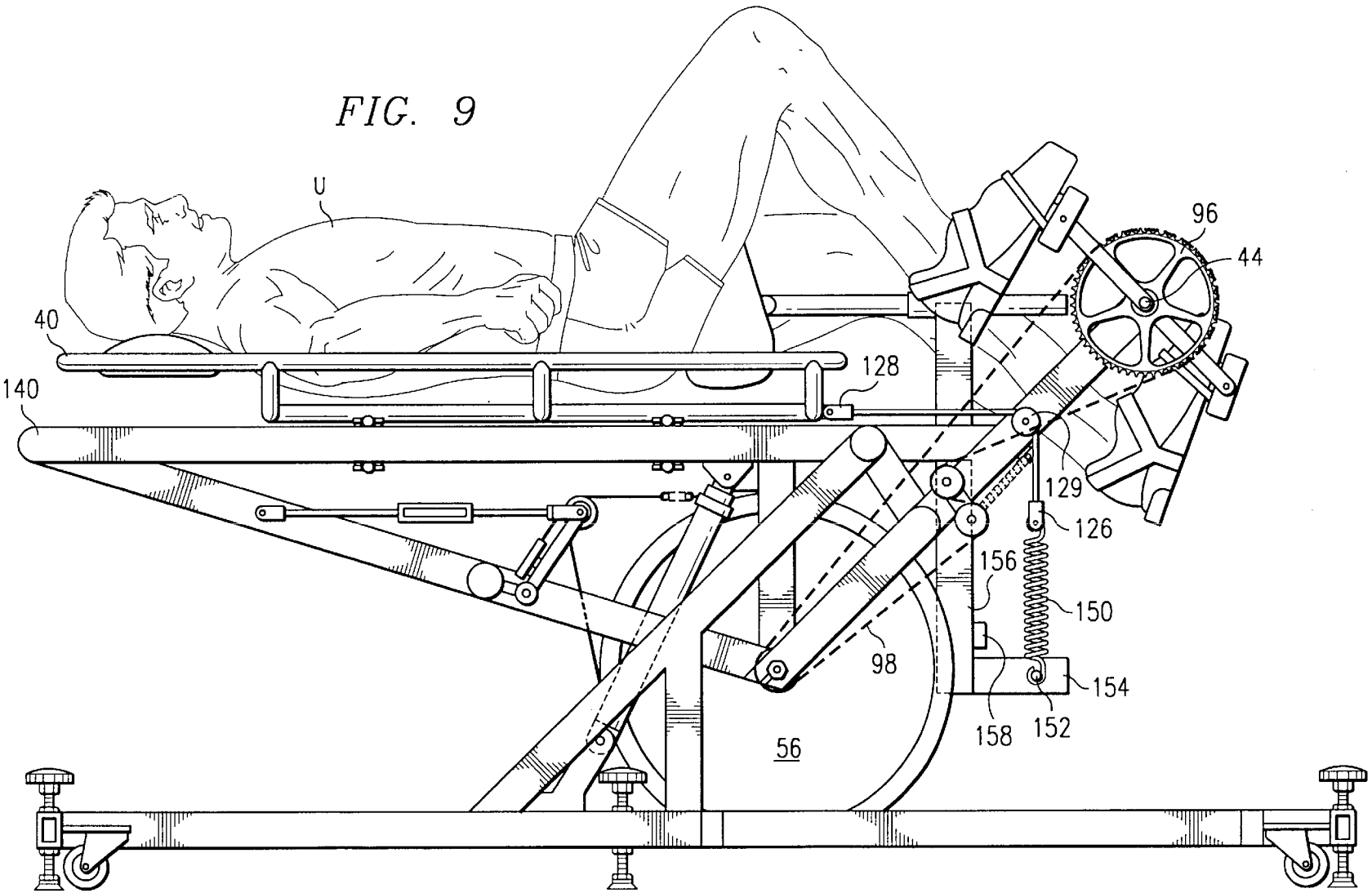
FIG. 9 is a simplified schematic elevational view of a fourth embodiment of the invention, in which tonic muscle exercise is provided with a tension spring.

FIG. 9 is yet another embodiment of the invention somewhat similar to that shown in FIG. 8. In this embodiment, the sled 40 slides horizontally in relation to a fixed frame 140, as before. In the embodiments shown in FIGS. 8 and 9, the frame 140 does not pivot with respect to the rest of the structure. In this embodiment, a cable 126 is attached to the nearer end 128 of the sled 40 and is redirected around a pulley 129 to be attached to a tension spring 150. An end 152 of the tension spring 150 is attached to a plate 154. The plate 154 is in turn slidable within a channel (not shown) of a vertical extension member 156. The vertical extension member 156 is affixed or made integral with the fixed frame 140. An adjustment mechanism 158, such as a tongue and ratchet track, is provided in conjunction with the movable plate 154 to position the plate on the vertical member 156, in order to vary the amount of spring force exerted by the tension spring 150. The tension spring 150 acts to bias the sled 40 toward the crank 44, thus imposing a tonic load on the legs of the exercising user U. In this embodiment, the phasic exercise activity is provided by chainring 96, chain 98, and flywheel 56, as before.

Figure 10:
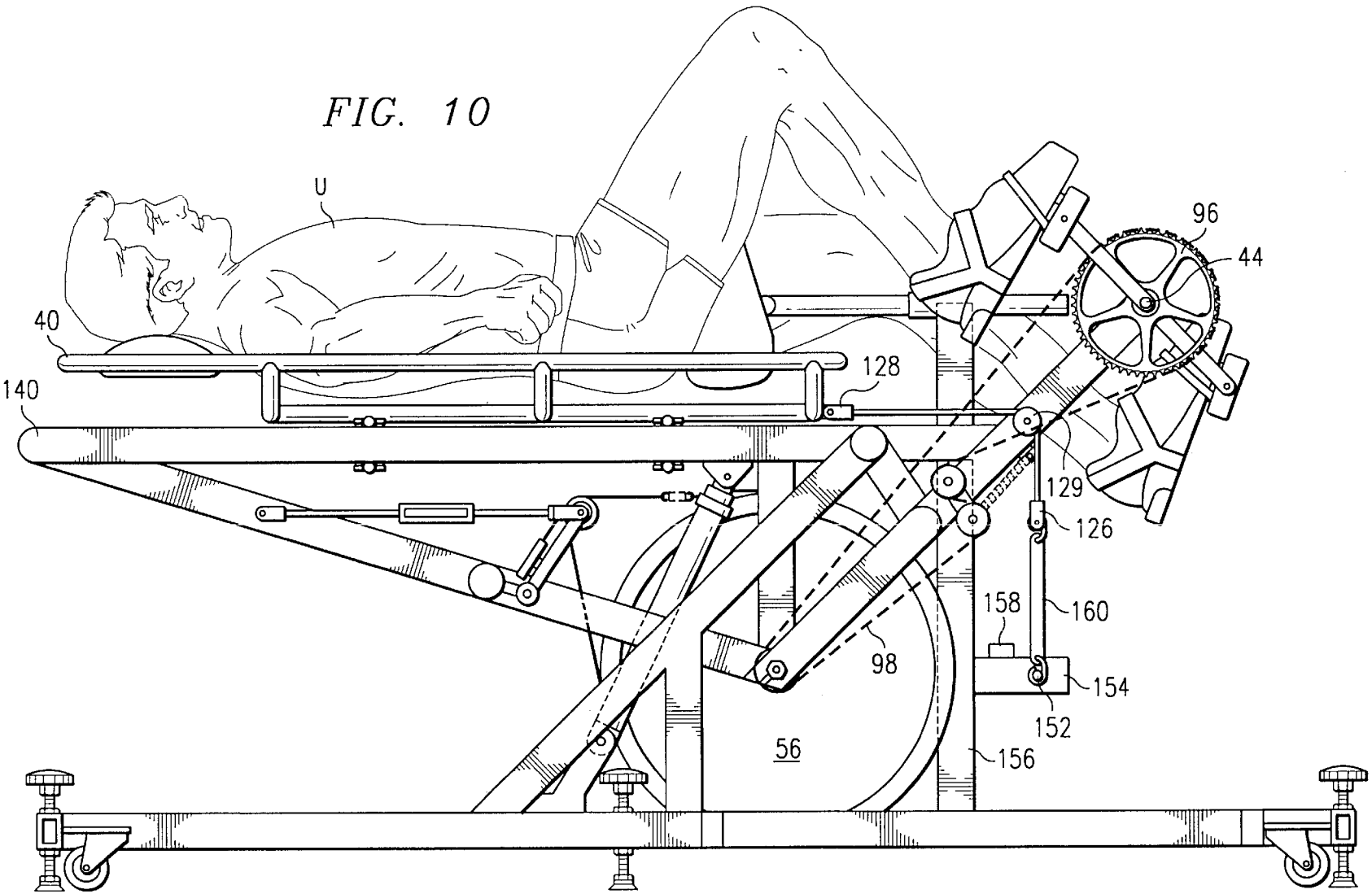
FIG. 10 is a simplified schematic elevational view of a fifth embodiment of the invention, in which tonic muscle exercise is provided with an elastomeric cord.

FIG. 10 is an embodiment much like the one shown in FIG. 9, but instead of a metallic tension spring 150, an elastomeric cord 160 is used to provide the biasing of the sled 40 toward the crank 44. The tension or spring force exerted by the elastomeric cord 160 is adjusted by positioning the plate 154 in respect of a channeled vertical member 156, as in FIG. 9.

Figure 11:
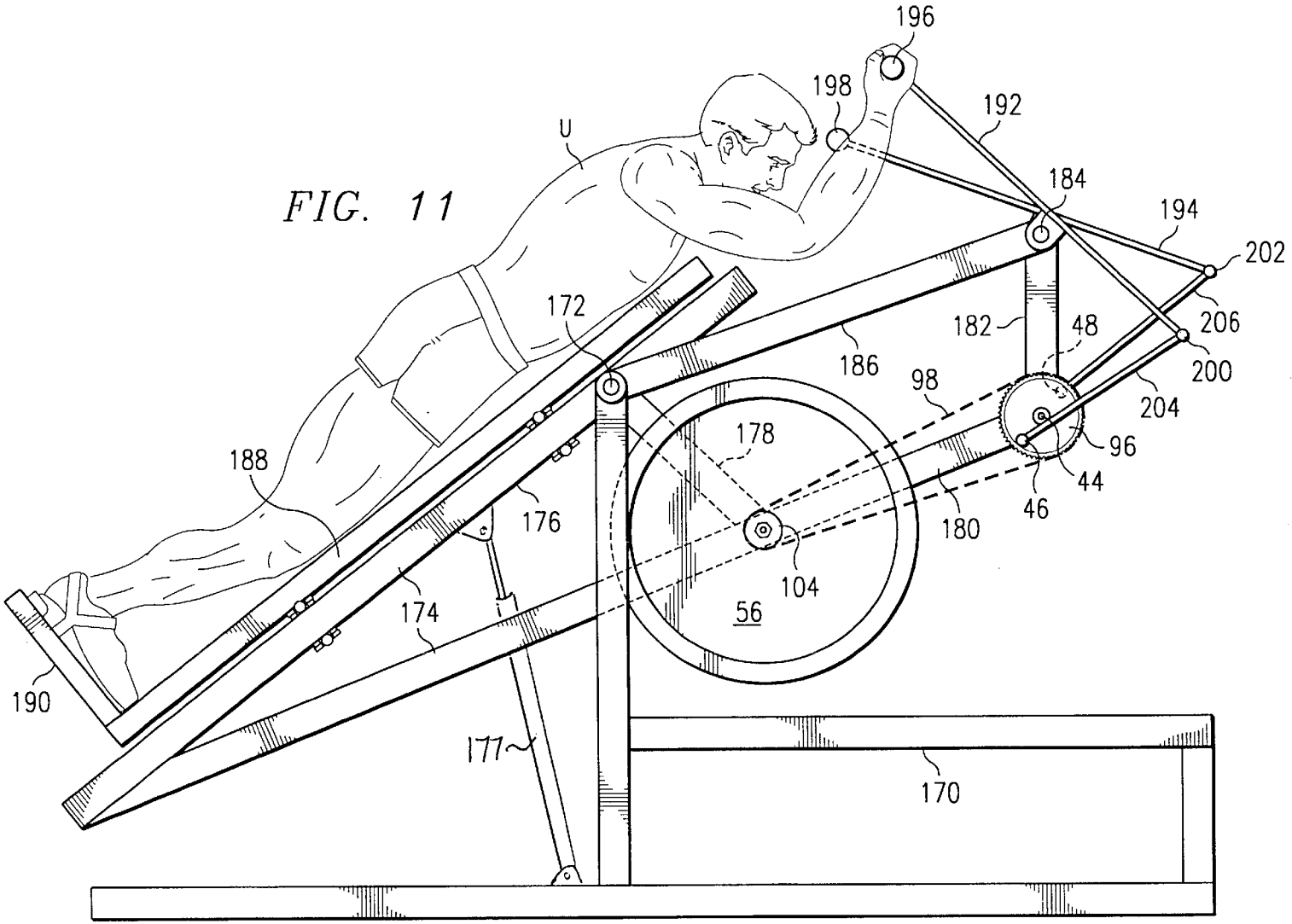
FIG. 11 is a simplified schematic elevational diagram of a sixth embodiment of the invention, in which muscle exercise is provided to the arms of the user.

FIG. 11 shows an embodiment in which the extremities exercised are the arms rather than the legs. In this embodiment, a fixed frame 170 supports the remainder of the apparatus around a pivot 172. A pivot frame 174 is connected to the fixed frame 170 through the pivot 172, and is affixable in place by means such as lead screws 177 (one of two shown). The fixed frame 174 will include at least a sled receiving frame 176, a flywheel stay member 178, a member 180 which structurally spaces the flywheel 56 from the crank 44, a member 182 which structurally spaces the crank 44 from an arm link pivot point 184, and a member 186 which spaces the arm link pivot point from the sled frame pivot 172. The sled frame is tiltable to any of a plurality of attitudes with respect to the horizontal.

A movable sled 188 freely slides on the sled-receiving frame or member 176. The sled 188 includes a foot rest 190, which may be adjustable according to the user's height. Rotatably attached to the pivot 184 are a pair of rigid arm links 192 that are fitted, at their upper ends, with respective handles 196 and 198. Lower ends of the arm lengths 192 and 194 are hingedly connected a pair of pivots 200 and 202, respectively. The pivot 200 is connected by a link 204 to a crank arm 46. The hinge 202 is connected by a rigid link 206 to the end of a crank arm 48. The crank arms 46 and 48 are in turn rigidly connected to a crank 44, which is concentrically fitted with a chainring 96. As per the other embodiments, a chain 98 mechanically connects the chainring 96 to a sprocket 104 of the flywheel 56.

In the operation of this embodiment, the user U lies prone upon the movable sled 188 and grasps the handles 196 and 198. The user U pulls on the handles 196 and 198 by an amount which produces a phasic activity as well as supports a portion of the weight of the prone user U. Once again, the objective of the user U is to maintain a constant position on the movable sled 188, thereby providing tonic exercise to the user's arms, while at the same time performing a phasic exercise with the handles 196 and 198. In an alternative embodiment (not shown) the user U can be negatively inclined so that the user U is pushing away from the fixed pivot 184 instead of pulling toward it, as shown. FIG. 11 is meant to be representative of those embodiments of the invention which are directed to exercising the upper extremities of the user U. Appropriate modifications of the other embodiments illustrated in this application may be made in order to provide upper extremity exercise.

Figure 12:
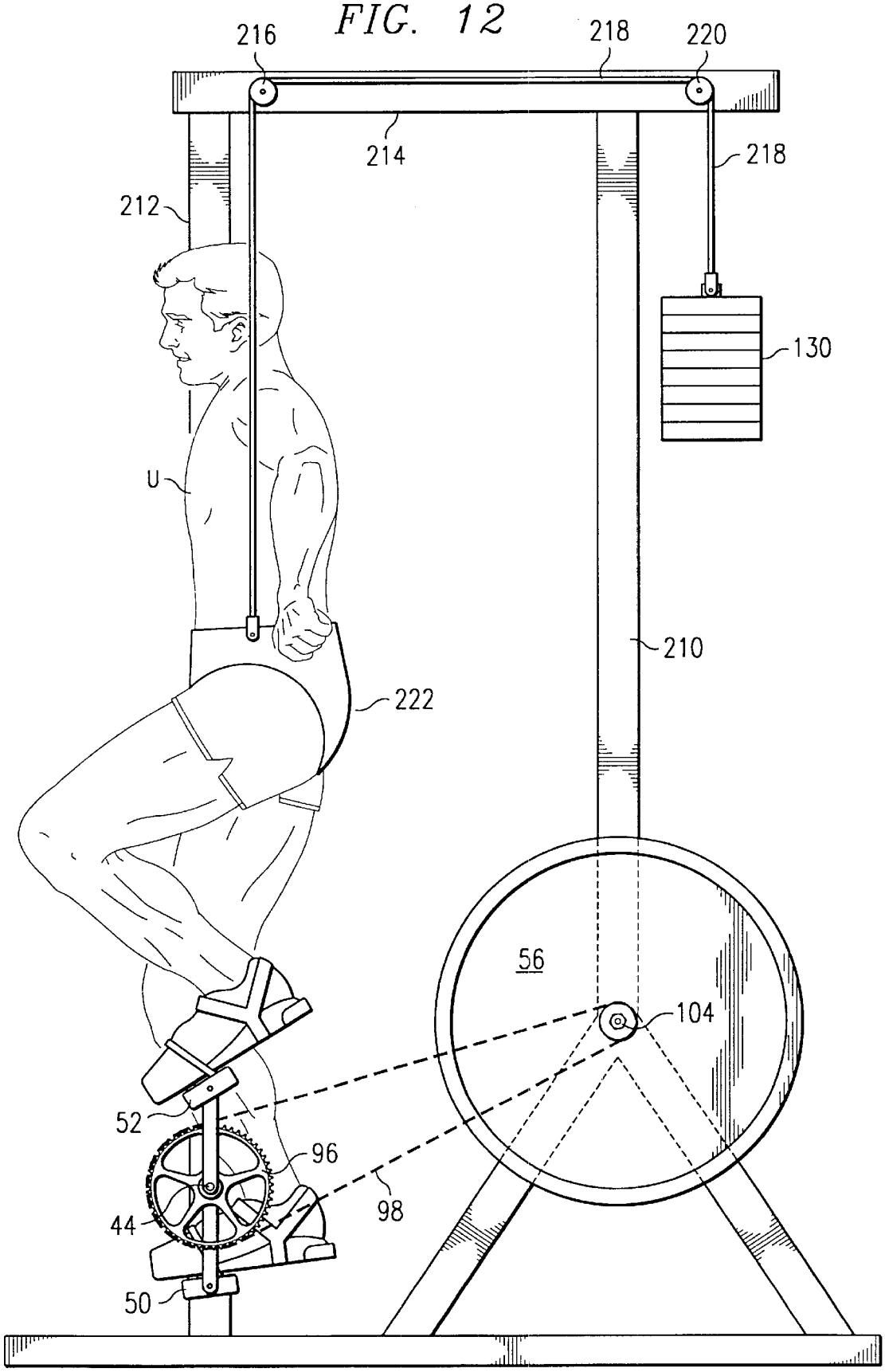
FIG. 12 is a simplified schematic elevational view of a seventh embodiment of the invention, in which a selected portion of the weight of the user is supported in a boatswain chair and the remainder used to provide supportive load to the legs.

FIG. 12 illustrates a further embodiment of the invention, in which a portion of the weight of the user U is supported by a system of weights 130. In this embodiment, a rigid frame 210 fixedly supports a crank 44 as well as the flywheel 56. The mechanics of the crank 44, chainring 96, chain 98 and flywheel 56 are as have been previously described. The user U is suspended by means of a pair of cables (one shown) 212 from a beam 214 which itself is made a portion of the rigid frame 210. The cable(s) 212 is/are looped over a first pulley 216. A cable segment 218, which may be connected end-to-end to the user support cables 212, extends from a point before the pulley 216 to a down pulley 220, where it is redirected to the top of a weight stack 130.

The cables 212 suspend a boatswain chair 222 having leg holes for the user U. This boatswain chair 222 supports a portion of the weight of the user U. The rest of the weight of the user U is supported via his legs on the pedals 50 and 52 and the crank 44. The amount of phasic activity can be adjusted by adjusting the tension of the flywheel 56, as before. The amount of tonic loading on the legs of the user U can be adjusted by removing or adding onto the stack of weights 130. This embodiment may be particularly advantageous as it places the user U in an upright position most akin to walking, but uses closed-chain mechanics so that undue stress is not placed upon the joints of the user's legs. In this and other embodiments, the user may be directed to try to keep his or her feet stationary and intentionally move his or her torso, performing a "squat" exercise. The failure of the user U to keep his or her feet stationary would be diagnostic of poor motor control on one or both sides. Further, this embodiment may be used by adjusting the weight stack 130 to be more than the weight of the user U, causing a negative loading of the leg muscles. This would put a tonic load on those muscles designed to bend the leg or pull the leg upward.

In operation, the present invention may be used to determine the optimal loading to which the user should be subjected. Beyond this optimal level, the user is unable to sustain the tonic loading applied to the muscles of the extremities in question, and collapse toward the crank will result. Determining and exercising at the optimal loading will allow a high degree of bilateral, symmetrical strengthening to occur. After a certain period of training under what was initially optimal conditions, the user should develop sufficient strength to tolerate higher loads, and therefore a new optimal loading can be identified and used.

There are many impaired populations who can benefit from the use of the invention. In general, any population with weakness, pain or loss of balance control can benefit. Without limitation, the present invention can help the following populations:

a. Locomotor Deficits. Populations who require assistance to walk, or to maintain upright stability during walking, can use the invention to reacquire the strength necessary to be able to walk without assistance. Strength is acquired within a functional context so that muscles get strong while practicing locomotor tasks. Examples include patients with stroke, brain injury, spinal cord injury, arthritis, post-surgical patients, and other neurological and orthopedic ailments and conditions.

b. Sensory Deficits and Balance Control. Populations who have lost the ability to sense their position in space will benefit by using body-position feedback. This feedback can retrain the user to learn where his body is with respect to gravity and correct his position by changing the force output in either or both legs.

c. Back and Leg Pain. Populations with pain can benefit by using the pedaling ergometer at very low body loads so that the painful structures can be exercised under low stress conditions. In addition, the absence of a bicycle seat (in some embodiments) allows for a comfortable reclining position to be maintained during training.

d. Osteoporosis. Carefully administered load-bearing exercises are essential for treatment of persons with osteoporosis. The graded weight-bearing capabilities of this device and the lack of weighting onto the low back (because, in some embodiments, of the lack of a seat) allows these patients to practice progressively higher degrees of loading in a safe and comfortable manner.

e. Cardiovascular Problems. The cardiovascular system responds to this exercise by increasing heart rate, blood pressure and respiratory rate. These effects are marked and can lead to an overall cardiovascular conditioning effect.

In summary, novel physical therapy or exercise apparatus have been shown and described that combine tonic and phasic muscle loading, such as normally occurs during walking or running. The present invention therefore provides an advantageous exercise and testing apparatus that is better able to test whether a user will have trouble with locomotor activities as well as to restore locomotor function to users.

While certain embodiments of the present invention have been described in the above detailed description and have been illustrated in the accompanying drawings, the present invention is not limited thereto but only by the scope and spirit of the appended claims.

I claim:

1. Exercise apparatus, comprising:

a frame;

first and second pedals adaptable to receive the feet of a user and articulably connected to the frame, each pedal movable through a range of motion and adaptable to physically exercise a leg of the user;

a generally flat sled configured for receiving a back and torso of a user and slidably connected to the frame, the sled slidable toward and away from the pedals so that the user must exert force on said user's legs to maintain the sled and the torso in a position away from said pedals while said user is pedaling with said pedals, the force exerted to maintain said sled and said torso away from said pedals creating tonic exercise of said legs of the user, the sled permitting a range of flexion of the legs at the hip joint from a bent position to a fully extended, straight position while the user's feet engage the pedals and while said user's back is engaged to said sled; and a source of resistance to pedal movement coupled to each of the pedals.

2. The apparatus of claim 1, wherein the first and second pedals are connected to a crank and each move through an endless loop.

3. The apparatus of claim 2, wherein the locus of each of the pedals is a circle.

4. The apparatus of claim 1, wherein the sled slides through a linear range of motion.

5. The apparatus of claim 1, wherein a pivot frame is pivotally connected to the frame, the sled slidably mounted on the pivot frame.

6. The apparatus of claim 5, and further including an angular affixation mechanism coupling the pivot frame to the frame, whereby a person may select the degree to which the user's weight is supported by the user's legs.

7. The apparatus of claim 1, and further comprising a sled displacement measurement mechanism for measuring the amount of displacement of the sled toward and away from the pedals.

8. The apparatus of claim 7, wherein the sled displacement measurement mechanism is a linear potentiometer.

9. The apparatus of claim 7, and further comprising a displacement signal generator coupled to the sled displacement measurement mechanism for generating a displacement signal, a feedback loop sensible by the user providing feedback as a function of the displacement signal.

10. The apparatus of claim 1, wherein said frame further includes a rail for slidably receiving the sled, and wherein the sled has a user support surface disposed at an angle with respect to the horizontal which is at least as great as an angle of the rail with respect to horizontal.

11. The apparatus of claim 10, wherein the rail is inclined, and wherein the user support surface is parallel to the inclined rail.

12. The apparatus of claim 1, wherein the sled and frame are configured so that a user's torso lying on the sled defines a generally extending direction pointing toward the pedals.

13. The apparatus of claim 12, wherein the sled further includes a rotatable portion for rotating the sled relative to horizontal, and wherein the generally extending direction of the torso pointing toward the pedals is maintained regardless of the position of the sled.

14. The apparatus of claim 1, further comprising a biasing system for creating an urging force for urging said sled in a certain direction on said frame, said urging force being opposed by said force exerted by said user in order for said user to maintain said sled away from said pedals.

15. The apparatus of claim 14, wherein said biasing system includes at least one selected from the group consisting of:

(a) a mechanism for tilting said sled so that gravity forces said sled to slide on said frame, (b) weights attached to said sled, (c) a tension spring attached to said sled, (d) a compression spring attached to said sled, and (e) an elastic cord attached to said sled.

16. Apparatus for exercising a muscle group of a user, comprising:

a frame;

a first system articulably coupled to the frame and engageable by a user's legs for providing phasic muscle activity of the legs; and a second system articulably coupled to the frame and engageable by the legs for applying a constant supportive load on the legs while the legs engage the first system, the failure of the muscle group to bear the supportive load causing the second system to be displaced relative to the frame, the second system permitting a range of flexion of the legs at the hip joint from a bent position to fully extended, straight position while the user's legs are engaging the first system.

17. The apparatus of claim 16, wherein said second system includes a generally flat sled for receiving a torso of the user, said sled slidably attached to a rail and configured for engaging said torso of said user, said supported load on said legs created by said user maintaining said torso and said sled in a position along said rail while said user engages said first system.

18. The apparatus of claim 16, wherein said first system includes pedals that engage feet of said user.

19. The apparatus of claim 16, further comprising a biasing system for creating an urging force for urging the second system in a certain direction on said frame, said urging force being opposed by said user in order for said user to maintain the second system away from the first system.

20. The apparatus of claim 19, wherein said biasing system includes at least one from the group consisting of:

(a) a mechanism for tilting the second system so that gravity forces the second system to slide on said frame, (b) weights attached to the second system, (c) a tension spring attached to the second system, (d) a compression spring attached to the second system, and (e) an elastic cord attached to the second system.

* * * * *